US010871333B2

(12) United States Patent
Hedberg

(10) Patent No.: US 10,871,333 B2
(45) Date of Patent: Dec. 22, 2020

(54) PORTHOLE GASKET AND ASSEMBLY FOR A HEAT EXCHANGER

(71) Applicant: ALFA LAVAL CORPORATE AB, Lund (SE)

(72) Inventor: Magnus Hedberg, Hjärup (SE)

(73) Assignee: ALFA LAVAL CORPORATE AB, Lund (SE)

( * ) Notice: Subject to any disclaimer, the term of this patent is extended or adjusted under 35 U.S.C. 154(b) by 5 days.

(21) Appl. No.: 16/062,869

(22) PCT Filed: Dec. 6, 2016

(86) PCT No.: PCT/EP2016/079799

§ 371 (c)(1),
(2) Date: Jun. 15, 2018

(87) PCT Pub. No.: WO2017/102410

PCT Pub. Date: Jun. 22, 2017

(65) Prior Publication Data

US 2019/0003783 A1 Jan. 3, 2019

(30) Foreign Application Priority Data

Dec. 16, 2015 (EP) ..... 15200314

(51) Int. Cl.

| | |
|---|---|
| ***F28F 3/10*** | (2006.01) |
| ***F28F 3/08*** | (2006.01) |
| ***F28D 9/00*** | (2006.01) |

(52) U.S. Cl.

CPC ..... *F28F 3/10* (2013.01); *F28D 9/0043* (2013.01); *F28F 3/083* (2013.01); *F28F 2230/00* (2013.01); *F28F 2275/205* (2013.01)

(58) Field of Classification Search

CPC ..... F28F 3/10; F28F 3/083; F28F 2230/00; F28F 2275/205; F28D 9/0043

See application file for complete search history.

(56) References Cited

U.S. PATENT DOCUMENTS 4,063,591 A * 12/1977 Usher ..... F28F 3/083 165/167

6,062,305 A 5/2000 Persson (Continued)

FOREIGN PATENT DOCUMENTS

CN 1748119 A 3/2006
CN 2864560 Y 1/2007

(Continued)

OTHER PUBLICATIONS

EP-0864837-A2 MT (Year: 1998).*

(Continued)

*Primary Examiner* — Gordon A Jones
(74) *Attorney, Agent, or Firm* — Buchanan Ingersoll & Rooney PC

(57) ABSTRACT

A porthole gasket to be installed between a corrugated first plate and a second plate of a heat exchanger such that a central extension plane of the gasket is parallel to the first and second plates is annular and arranged to enclose, within the gasket inner periphery, porthole areas of the first and second plates. A first surface of the gasket, configured to engage the first plate, is corrugated to define alternately arranged gasket ridges and gasket valleys along a longitudinal extension of the gasket. The ridges and valleys mate with plate valleys and plate ridges, respectively, of the first plate. A second surface of the gasket, configured to engage a plate arrangement comprising the second plate, is essentially plane and arranged to contact an essentially plane surface of the plate arrangement. The ridges protrude, and the valleys descend, in a normal direction of the central extension plane.

17 Claims, 7 Drawing Sheets

(56) References Cited

U.S. PATENT DOCUMENTS

| | | | | |
|---|---|---|---|---|
| 6,245,451 | B1 | 6/2001 | Kamisawa et al. | |
| 7,424,908 | B2 * | 9/2008 | Blomgren | F28D 9/005 165/167 |
| 2005/0116427 | A1 | 6/2005 | Seidel et al. | |
| 2006/0048927 | A1 | 3/2006 | Blomgren | |
| 2006/0249282 | A1 * | 11/2006 | Song | F28F 3/10 165/167 |
| 2009/0008072 | A1 * | 1/2009 | Rassmus | F28D 9/005 165/167 |
| 2009/0194267 | A1 * | 8/2009 | Gustafsson | F28D 9/005 165/168 |
| 2010/0187771 | A1 * | 7/2010 | Waltenberg | F01N 13/1827 277/595 |
| 2014/0251586 | A1 | 9/2014 | Persson | |
| 2015/0330720 | A1 | 11/2015 | Hedberg et al. | |

FOREIGN PATENT DOCUMENTS

| | | | | |
|---|---|---|---|---|
| CN | 101484771 | A | 7/2009 | |
| CN | 103968701 | A | 8/2014 | |
| DE | 12 59 849 | B | 2/1968 | |
| DE | 21 12 168 | A1 | 10/1971 | |
| DE | 195 40 271 | C1 | 11/1996 | |
| EP | 0 864 837 | A2 | 9/1998 | |
| EP | 0864837 | A2 * | 9/1998 | F28F 3/083 |
| EP | 2 762 823 | A1 | 8/2014 | |
| GB | 1207016 | A * | 9/1970 | F28F 3/083 |
| GB | 2 000 267 | A | 1/1997 | |
| JP | H10-339596 | A | 12/1998 | |
| JP | H11-514731 | A | 12/1999 | |
| JP | 2004-125222 | A | 4/2004 | |
| JP | 2006-517648 | A | 7/2006 | |
| KR | 10-2015-0108924 | A | 9/2015 | |
| RU | 2 431 795 | C2 | 10/2011 | |
| RU | 2 562 347 | C1 | 9/2015 | |
| WO | WO 87/04234 | A1 | 7/1987 | |
| WO | 97/16691 | A1 | 5/1997 | |
| WO | WO 2004/072570 | A1 | 8/2004 | |
| WO | 2007/142592 | A1 | 12/2007 | |

OTHER PUBLICATIONS

Office Action (Notice of Preliminary Rejection) dated Jul. 19, 2019, by the Korean Intellectual Property Office in corresponding Korean Patent Application No. 10-2018-7016850 and an English Translation of the Office Action. (8 pages).

Office Action (Notice of Reasons for Rejection) dated Jun. 3, 2019, by the Japanese Patent Office in corresponding Japanese Patent Application No. 2018-531623, and an English Translation of the Office Action. (12 pages).

An English Translation of the First Office Action and Search Report dated May 28, 2019, by the State Intellectual Property Office of People's Republic of China in corresponding Chinese Patent Application No. 201680074234.8. (8 pages).

An English Translation of the Office Action dated Feb. 19, 2019, by the Russian Patent Office in corresponding Russian Patent Application No. 2018125882(040883). (7 pages).

International Search Report (PCT/ISA/210) dated Feb. 13, 2017, by the European Patent Office as the International Searching Authority for International Application No. PCT/EP2016/079799.

Written Opinion (PCT/ISA/237) dated Feb. 13, 2017, by the European Patent Office as the International Searching Authority for International Application No. PCT/EP2016/079799.

* cited by examiner

PORTHOLE GASKET AND ASSEMBLY FOR A HEAT EXCHANGER

TECHNICAL FIELD

The present invention relates to a porthole gasket and its design. The present invention also relates to an assembly for a heat exchanger comprising such a porthole gasket.

BACKGROUND OF INVENTION

Plate heat exchangers typically consist of two end plates in between which a number of heat transfer plates are arranged in an aligned manner. The heat transfer plates are corrugated so as to comprise ridges extending in an upper plane, and valleys extending in a lower plane. In one type of well-known PHEs, the so called gasketed plate heat exchangers, gaskets are arranged between the heat transfer plates, more particularly in gasket grooves extending along outer edges and around port holes of the heat transfer plates. The gasket grooves may extend in the lower plane and/or in an intermediate plane, also referred to as half-plane. The end plates, and therefore the heat transfer plates, are pressed towards each other whereby the gaskets seal between the heat transfer plates. The gaskets define parallel flow channels between the heat transfer plates through which channels two fluids of initially different temperatures alternately can flow for transferring heat from one fluid to the other.

The fluids enter and exit the channels through ports which extend through the plate heat exchanger and are formed by the respective aligned port holes in the heat transfer plates. The ports communicate with inlets and outlets, respectively, of the plate heat exchanger. The inlet and outlet of each one of the fluids may be formed in the same end plate or in different end plates. If they are formed in the same end plate this means that the fluid will enter and leave the heat exchanger at the same side of the heat exchanger. If they are formed in different end plates this means that the fluid will enter the heat exchanger at one side, and leave the heat exchanger at the opposite side. Depending on the design of the heat transfer plates, the latter case may demand a special design of the heat exchanger to achieve a tight seal between the end plate comprising the outlet and the outermost heat transfer plate such that no fluid can flow between the end plate and the outermost heat transfer plate. It is typically in connection with heat transfer plates comprising gasket grooves extending in the lower plane that a special design is required. One such special design involves the provision of recesses for gasket reception in the end plate. Such recesses are labor intensive and costly to make. Another special design is further described below with reference to FIGS. 1*a* and 1*b*.

FIGS. 1*a* and 1*b* illustrate a known plate heat exchanger 2 designed as described above (in a not completely tightened condition) and having the inlet for one of the fluids and the outlet 4 for the same fluid arranged on opposite sides of the plate heat exchanger, the outlet side being illustrated in the figures. For the other fluid the inlet and the outlet are arranged at the same side of the heat exchanger. FIG. 1*a* and/or FIG. 1*b* illustrate one end plate 6 of two end plates, two heat transfer plates 8 and 20 of a larger number of heat transfer plates (which are all similar and designed as illustrated in FIGS. 4*a* & 4*b*), a port 10 of four ports, the port 10 communicating with the outlet 4, two porthole gaskets 12 of a larger number of porthole gaskets, a transition plate 14, a ring gasket 16 of four ring gaskets and a collar ring 18. The last three components are present only at the outlet side of the plate heat exchanger. The ring gaskets are arranged at a respective one of the ports (not illustrated) to provide sufficient support between an outermost one 20 of the heat transfer plates and the transition plate 14. The collar ring is arranged at the port 10. Thus, no collar ring is arranged at the ports not communicating with an outlet in the end plate 6, i.e. at the other ports. Shown in FIG. 1*a* is also one lining 22 of four linings for protecting the end plate 6 from fluid exposure. With a suitable choice of material for the end plates, the linings could be omitted.

The end plates, heat transfer plates and transition plate all comprise four porthole areas each that either could be open so as to comprise a respective porthole or closed. All four porthole areas of all the heat transfer plates except the outermost heat transfer plates are typically open while some of the porthole areas of the outermost heat transfer plates, the transition plate and the end plates are open and some closed depending on the arrangement of the fluid inlets and outlets. So is also the case here. FIGS. 1*a* and 1*b* illustrate one porthole area each, 24, 26, 28 and 30, of the heat transfer plates 8 & 20, the transition plate 14 and the end plate 6, respectively. Clearly, the porthole areas 24, 26, 28 and 30 are all open so as to comprise a respective porthole. The porthole area of the transition plate 14 is larger than the porthole areas of the heat transfer and end plates. More particularly, with all porthole areas closed, the transition plate 14 is similar to the heat transfer plates. However, when the transition plate 14 is cut to open up one of its porthole areas, more material is cut off than when cutting open one of the porthole areas of one of the heat transfer plates. Thus, the transition plate 14 must be custom made.

As is clear from FIGS. 1*a* and 1*b*, the transition plate 14 is arranged between the outermost heat transfer plate 20 and the end plate 6. The ring gasket 16 is arranged between the outermost heat transfer plate 20 and the transition plate 14 around the open porthole area 28 of the transition plate. The ring gasket has a constant cross section along its extension. An annular portion of the ring gasket projects beyond an edge of the porthole and the collar ring keeps the ring gasket in place.

Thus, the above design requires manufacturing and assembly of three types of special components to assure a tight seal between the end plate 6 and the outermost heat transfer plate 20, which may be associated with a high consumption of money as well as time. Further, there will be no flow between the end plate 6 and the transition plate 14. Neither will there be a flow between the outermost heat transfer plate 20 and the transition plate 14. This means that the transition plate will have no heat transfer function—it is provided only for sealing purposes.

SUMMARY

The object of the present invention is to enable a more simple, less costly and more effective design of a heat exchanger having the inlet and outlet for one and the same fluid arranged on opposite sides of the heat exchanger. The basic concept of the invention is to replace the three special components of the above described known heat exchanger design with a new type of porthole gasket, i.e. one single component. The porthole gasket and a heat exchanger assembly comprising such a porthole gasket for achieving the object above are defined in the appended claims and discussed in further detail below.

The porthole gasket according to the present invention is for installation between a corrugated first plate and a second plate of a heat exchanger such that a central extension plane of the porthole gasket is parallel to the first and second plates. The porthole gasket is annular and arranged to enclose, within an inner periphery thereof, a porthole area of the first plate and a porthole area of the second plate. The porthole gasket is characterized in that a first surface of the porthole gasket, which is arranged to engage with the first plate, is corrugated so as to define alternately arranged gasket ridges and gasket valleys along a longitudinal extension of the porthole gasket. The gasket ridges and gasket valleys are arranged to mate with plate valleys and plate ridges, respectively, of the first plate. A second surface of the porthole gasket, which is arranged to engage with a plate arrangement comprising the second plate, is essentially plane and arranged to contact an essentially plane surface of the plate arrangement. The gasket ridges protrude, and the gasket valleys descend, in a normal direction of the central extension plane. Widths of the porthole gasket are measured parallel to the central extension plane and perpendicular to the longitudinal extension of the porthole gasket.

The first and second plates may be of different types including heat transfer plates, partition plates and end plates.

The plate arrangement may e.g. comprise a lining and the second plate, wherein the second surface of the porthole gasket may be arranged to contact the lining. Alternately, the plate arrangement may not comprise a lining, e.g. it may consist of the second plate, wherein the second surface of the porthole gasket may be arranged to contact the second plate.

By central extension plane of the porthole gasket is meant a plane which is parallel to a plane surface onto which the porthole gasket has been placed.

By the expression "parallel to the first and second plates" is meant parallel to a respective central or main extension plane of the first and second plates.

The porthole areas of the first and second plates could be either open so as to comprise a respective porthole, or closed.

In that the first surface of the porthole gasket comprises gasket ridges and gasket valleys arranged to engage with plate valleys and plate ridges, respectively, of the first plate, a tight and reliable seal between the first plate and the porthole gasket may be achieved.

In that the second surface of the porthole gasket is essentially plane and arranged to engage with an essentially plane surface of the plate arrangement, a tight and reliable seal between the plate arrangement and the porthole gasket may be achieved.

The porthole gasket may be such that the gasket ridges and the gasket valleys define the inner periphery of the porthole gasket. Such a design means that the gasket ridges and valleys are arranged as far in on the porthole gasket as possible which makes the gasket suitable for first plates having porthole areas surrounded and delimited by plate valleys and ridges, which typically is the case.

The first surface of the porthole gasket may define a first bead or rib extending along the longitudinal extension of the porthole gasket and protruding from the gasket ridges and gasket valleys in the normal direction of the central extension plane. Such a first bead may enable a locally increased gasket pressure resulting in an improved sealing capacity of the porthole gasket when this is squeezed between the first and second plates.

The first bead may extend continuously along the complete longitudinal extension of the porthole gasket, which may enable a locally increased gasket pressure along the complete porthole gasket, which in turn may enable an optimization of the porthole gasket sealing capacity.

The first bead may extend at an essentially continuous distance from the inner periphery of the porthole gasket.

The first bead may protrude from a respective top of the gasket ridges. The top of a gasket ridge is where the gasket ridge is the highest, a height of the gasket ridges being measured in the normal direction of the central extension plane. Such a first bead may enable optimization of the porthole gasket sealing capacity.

The porthole gasket may be such that a maximum width of the gasket ridges is smaller than a maximum width of the porthole gasket. Such an embodiment means that the porthole gasket extends beyond the gasket ridges which enables an increased contact and engagement between the porthole gasket and the first and second plates.

A width of the porthole gasket along the gasket ridges may be larger than the maximum width of the gasket ridges. Such an embodiment means that the gasket ridges do not occupy the complete width of the porthole gasket. This enables an increased contact and engagement between the porthole gasket and the first and second plates where it is typically required the most for reliable gasket fixation, i.e. along the gasket ridges.

A width of the porthole gasket along the gasket ridges may be larger than a width of the porthole gasket along the gasket valleys along a portion of the porthole gasket. This may mean that porthole gasket is provided with indentations between adjacent gasket ridges which may reduce the risk of the porthole gasket being crushed when it is squeezed between the first and second plates.

The porthole gasket may be so designed that its first surface defines a recess at each of a number of the gasket valleys, which recess extends in the normal direction of the central extension plane. Such a recess means a locally decreased gasket thickness that may reduce the risk of the porthole gasket being crushed when it is squeezed between the first and second plates.

The first surface of the porthole gasket may define a second bead or rib extending along the longitudinal extension of the porthole gasket and connecting a number of the gasket ridges. The second bead protrudes in the normal direction of the central extension plane and extends at a distance≠0 from the inner periphery of the porthole gasket. The second bead may extend along only a part of, or the complete, porthole gasket. The second bead may be arranged to be received in a groove of the first plate, which groove extends partly or completely around, and at a distance≠0 from, the porthole area of the first plate. Such a design may improve the engagement between the first plate and the porthole gasket.

The porthole gasket may be provided with an attachment means arranged to engage with an edge portion of the first plate, which edge portion defines a porthole of the first plate, for fastening the porthole gasket to the first plate. The attachment means may engage with, and extend from the inner periphery of, the porthole gasket. Such attachment means may make it easier to arrange and maintain the porthole gasket in the correct position between the first and second plates.

The attachment means may comprise a bridge which is spaced from the porthole gasket, a connection member connecting the bridge and the porthole gasket, and first and second fingers engaging with the bridge and extending from the bridge towards the porthole gasket. The connection member may be arranged to engage with a back side of the first plate and the first and second fingers may be arranged to engage with a front side of the first plate. Thereby, a reliable fastening of the porthole gasket to the first plate is enabled.

The porthole gasket may be such that a shortest distance between an outer periphery of the porthole gasket and each of the first and second fingers is shorter than a width of the porthole gasket where the connection member connects to the porthole gasket. This enables positioning of the porthole gasket close to the porthole of the first plate.

The connection member may connect to the porthole gasket at a first one of the gasket ridges, the first finger may extend at least partly between the first gasket ridge and an adjacent second one of the gasket ridges, and the second finger may extend at least partly between the first gasket ridge and an adjacent third one of the gasket ridges. Further, the first gasket ridge may be arranged between the second and third gasket ridges. Such an embodiment enables that the attachment means does not extend beyond the maximum height of the porthole gasket which in turn facilitates a tight engagement between the porthole gasket and the first and second plates.

An assembly for a heat exchanger according to the invention comprises a corrugated first plate, a second plate and a porthole gasket as described above installed between the first and second plates such that a central extension plane of the porthole gasket is parallel to the first and second plates. The first and second plates each comprises a porthole area enclosed by the porthole gasket. A first surface of the porthole gasket engages with plate ridges and plate valleys of the first plate, which plate ridges and plate valleys are alternately arranged around the porthole area of the first plate. A second surface of the porthole gasket engages with an essentially plane surface of a plate arrangement comprising the second plate, which plane surface extends around the porthole area of the second plate.

The first plate may be an outermost heat transfer plate of a pack of mutually aligned heat transfer plates and the second plate may be an end plate arranged to compress the pack of heat transfer plates. Alternately, the second plate may be a partitioning plate.

The porthole area of the first plate may be open so as to define a porthole. Thereby, passing of a fluid through the first plate is enabled.

The porthole areas of the first and second plates may be open so as to each define a porthole. Thereby, passing of a fluid through the first and second plates is enabled which makes the assembly suitable for a heat exchanger having the inlet and outlet for one and the same fluid arranged on opposite sides of the heat exchanger.

The first plate may comprise an annular embankment enclosing the plate ridges and plate valleys. Further, the porthole gasket may engage with a top surface of the embankment of the first plate, which top surface is parallel to the central extension plane of the porthole gasket. Typically, it will be the part of the porthole gasket extending beyond the gasket ridges in a width direction (described above) that will engage with the top surface of the embankment for optimized gasket-plate engagement.

A heat exchanger may comprise an assembly as described above.

The above described advantages of the different designs of the porthole gasket according to the invention are typically transferable to the assembly for a heat exchanger according to the invention as this comprises the porthole gasket.

Further aspects of the invention are apparent from the dependent claims and the description.

BRIEF DESCRIPTION OF THE DRAWINGS

Further objects, features and advantages will appear from the following detailed description of several embodiments of the invention with reference to the drawings, in which.

DETAILED DESCRIPTION OF EMBODIMENTS

Figure 1A:
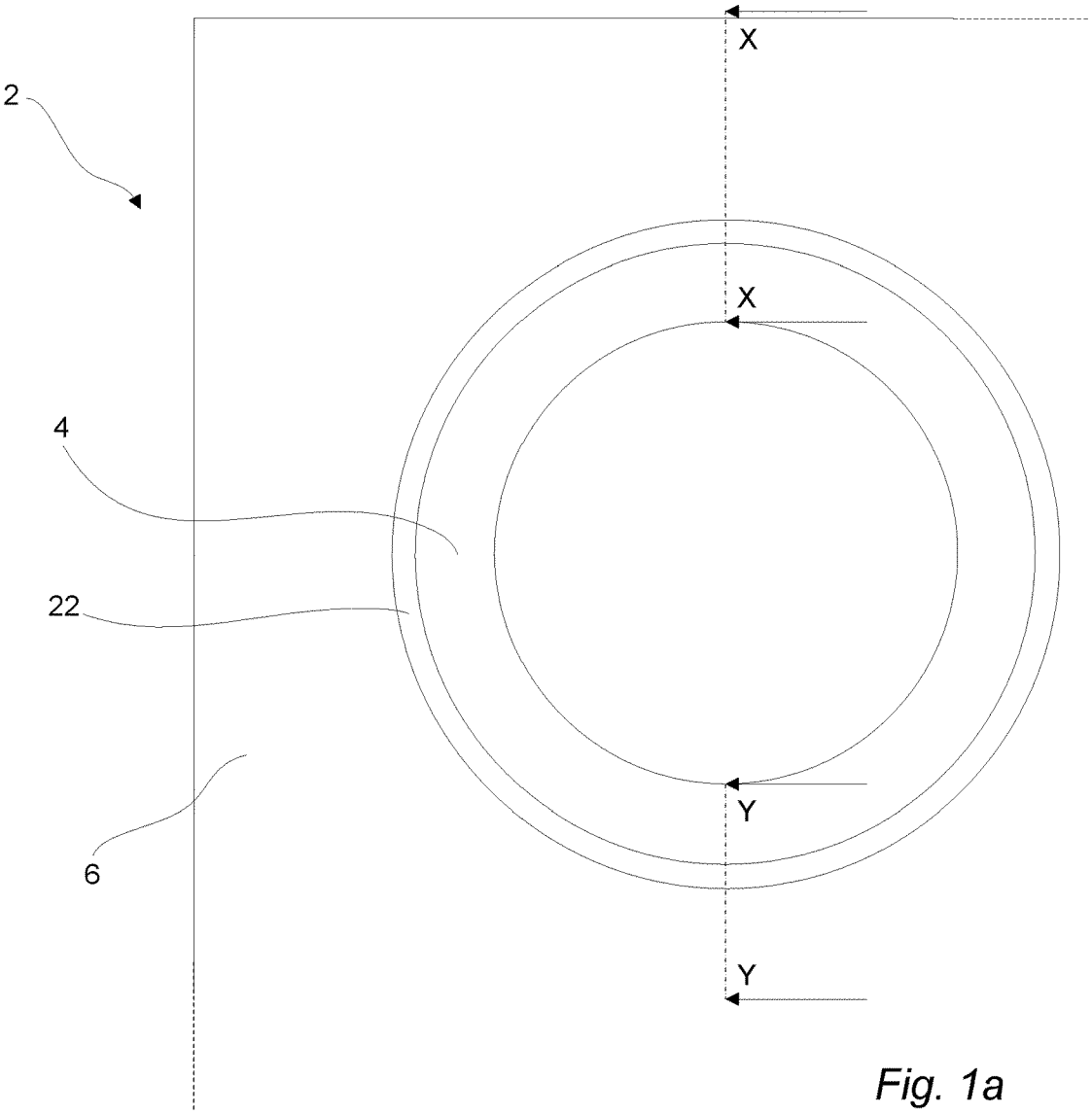
FIG. 1*a* is a schematic partial plan view of a known plate heat exchanger.
Figure 1B:
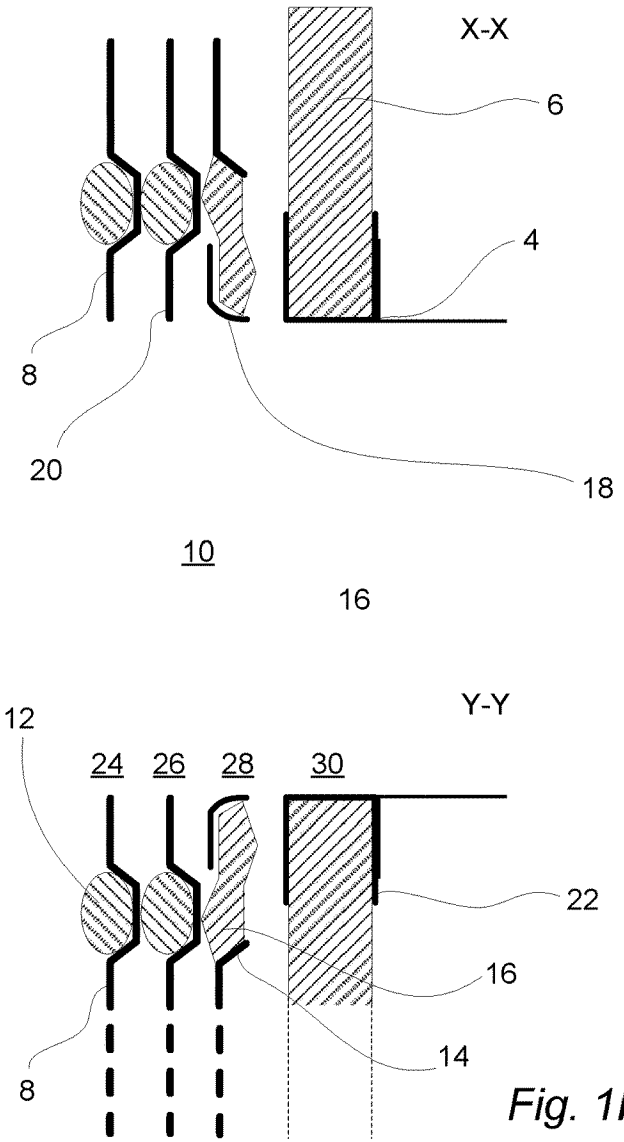
FIG. 1*b* schematically illustrates cross sections along lines X-X and Y-Y in FIG. 1*a*.
Figure 2A:
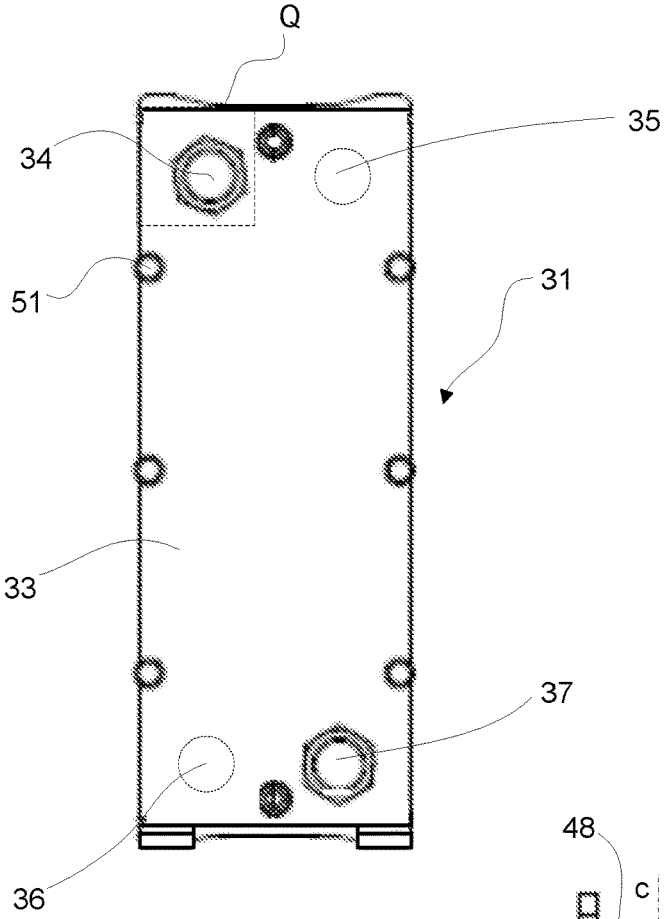
FIG. 2*a* is a front view of a plate heat exchanger comprising an assembly according to the invention.
Figure 2B:
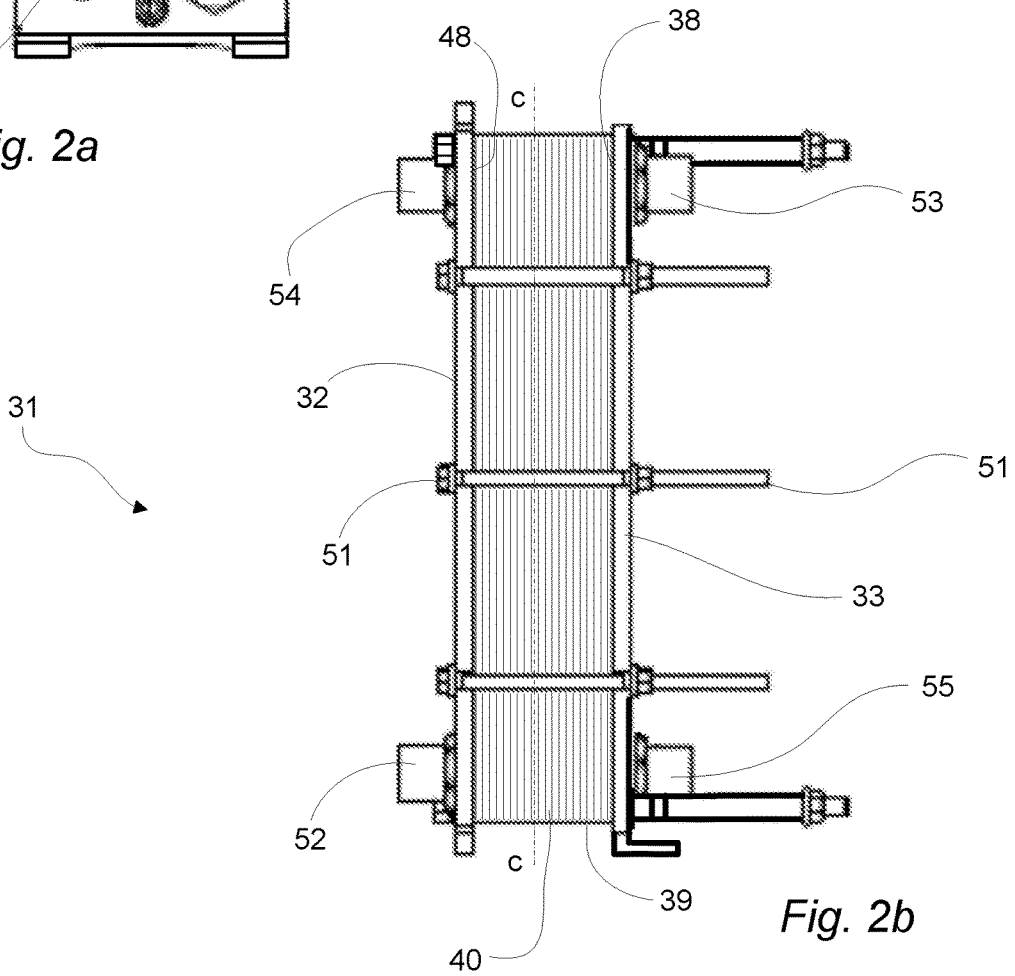
FIG. 2*b* is a side view of the plate heat exchanger in FIG. 2*a*.

In FIGS. 2*a*, 2*b*, 3*a* and 3*b* a gasketed plate heat exchanger 31 is illustrated. It comprises a first end plate 32 and a second end plate 33 ("second plate" in the claims), which hereinafter will be referred to as frame plate 32 and pressure plate 33, respectively. The frame and pressure plates are made of stainless steel and each comprise four porthole areas which either may be closed or open so as to define a respective porthole. Here, the frame and pressure plates each comprise two open and two closed porthole areas. The porthole areas 34-37 of the pressure plate 33 are illustrated in FIG. 2*a*, the closed ones with dashed circles. One of the open porthole areas 34 of the pressure plate 33, is also visible in FIG. 3*b*. An inner surface 38 of the pressure plate 33, just like an inner surface 48 of the frame plate 32, is essentially plane.

The heat exchanger further comprises a pack 39 of mutually aligned similar stainless steel heat transfer plates 40 arranged between the frame and pressure plates, 32 and 33, respectively. Each of the heat transfer plates comprises four porthole areas which either may be closed or open so as to define a respective porthole. The porthole areas of the heat transfer plates are all uniform and of the same size. Here, they are not circular but "curved triangular" so as to have a varying "radius". The porthole areas of the pressure plate and the frame plate are all uniform and of the same size. Here, they are circular with a radius equal to the minimum "radius" of the porthole areas of the heat transfer plates.

Figure 3A:
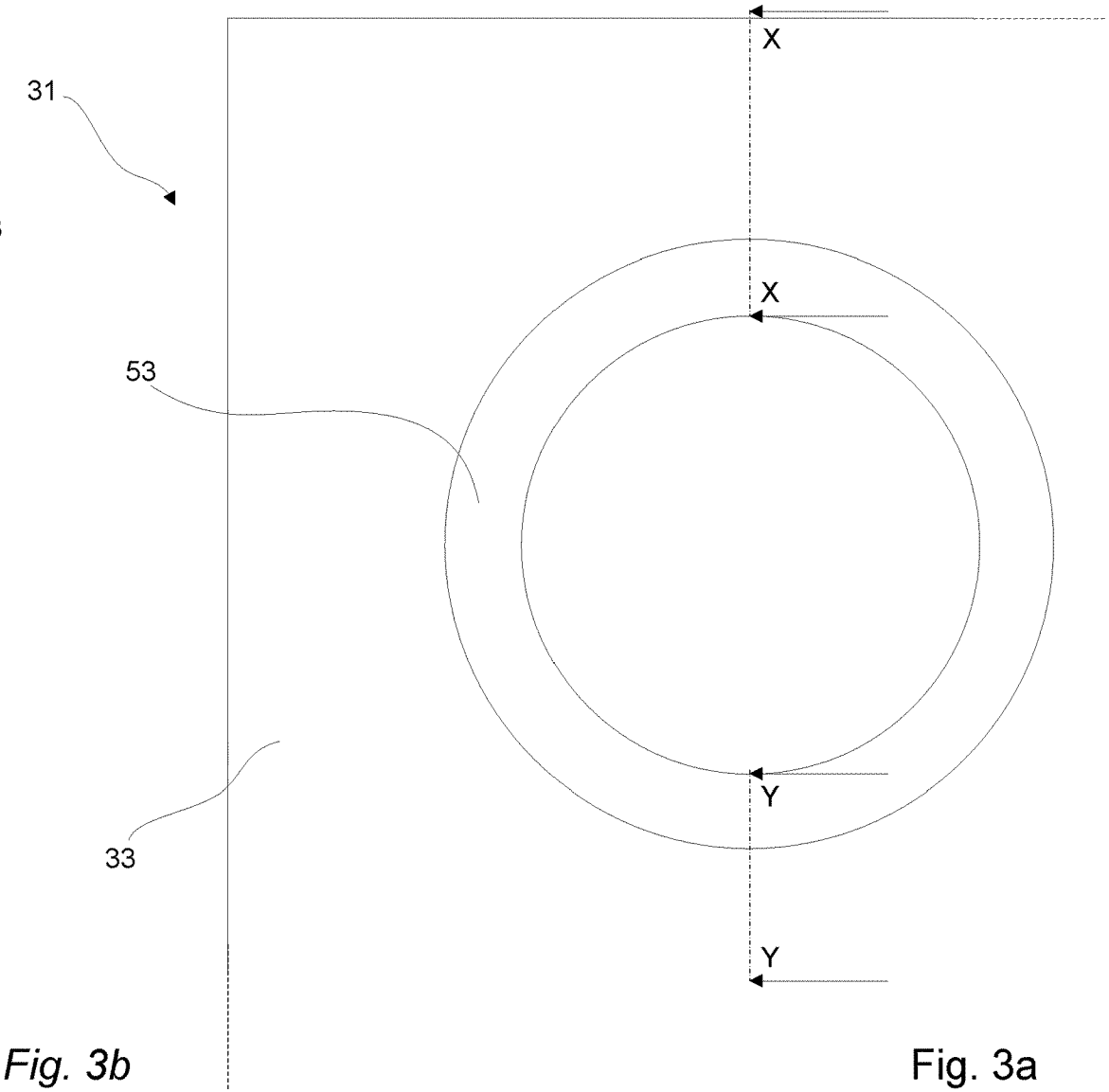
FIG. 3*a* is an enlarged, schematic and simplified plan view of portion Q of FIG. 2*a*, FIG. 3*b* schematically illustrates cross sections along lines X-X and Y-Y in FIG. 3*a*.
Figure 3B:
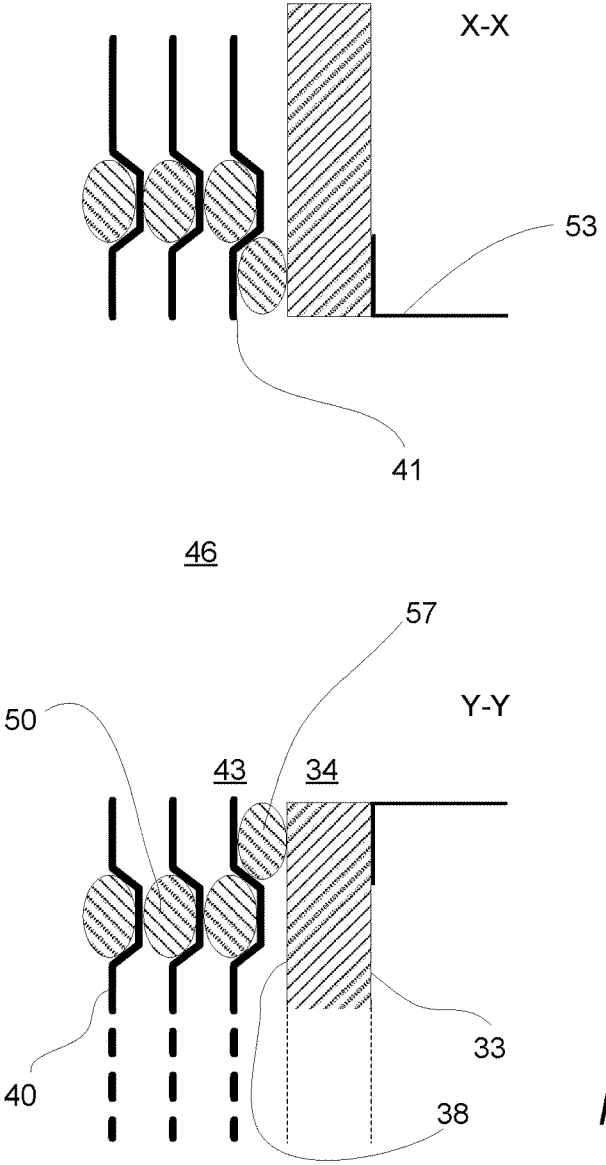
Figure 4A:
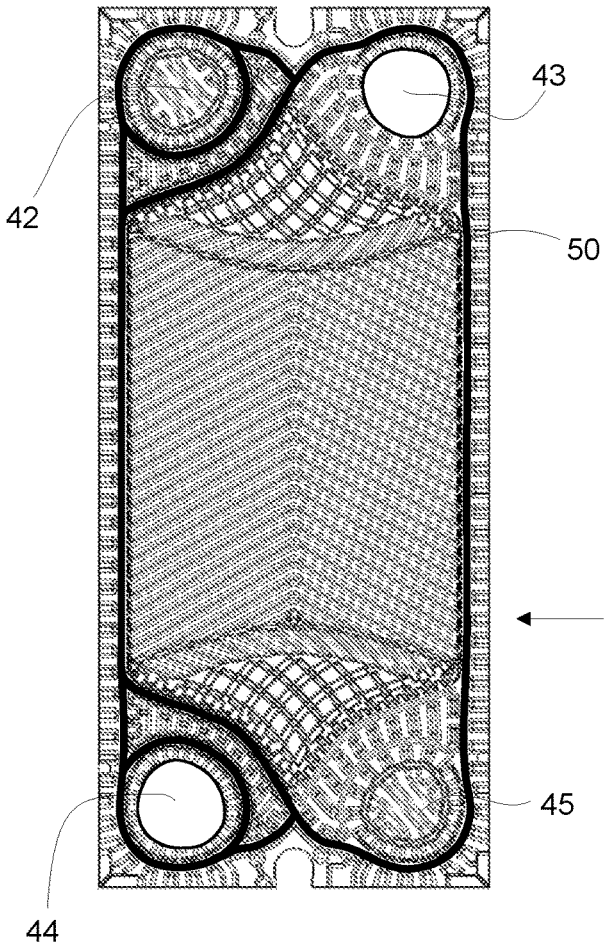
FIG. 4*a* is a plan front view of a heat transfer plate provided with a gasket.
Figure 4B:
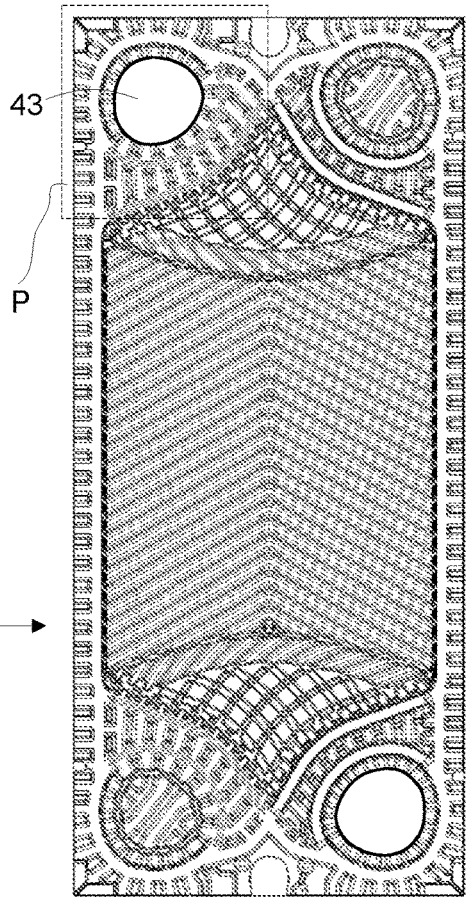
FIG. 4*b* is a plan back view of the heat transfer plate of FIG. 4*a*.
Figure 4C:
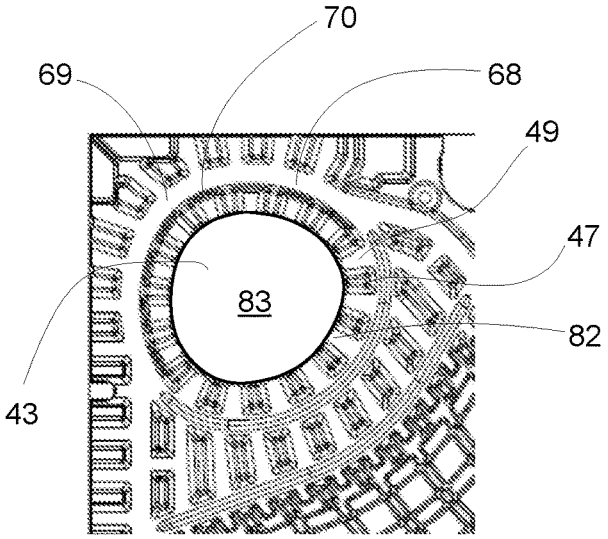
FIG. 4*c* is an enlargement of a portion P of FIG. 4*b*, FIG. 4*d* corresponds to FIG. 4*c* but shows the portion P provided with a porthole gasket.
Figure 4D:
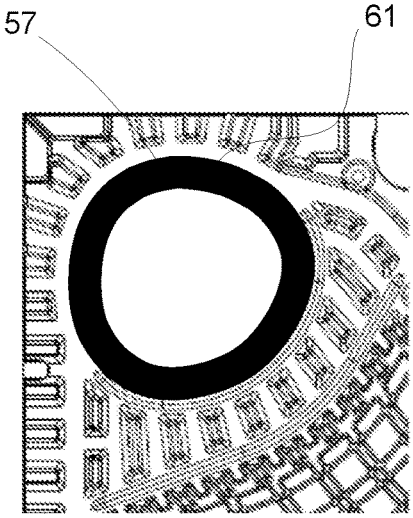

An outermost heat transfer plate 41 ("first plate" in the claims) arranged closest to the pressure plate 33 is illustrated in further detail in FIGS. 4*a*, 4*b*, 4*c* and 4*d*. The surface of the heat transfer plate which is visible in FIG. 4*a* is arranged to face away from the pressure plate 33 while the surface visible in FIGS. 4*b*, 4*c* and 4*d* is arranged to face the pressure plate 33. The heat transfer plate 41 has four porthole areas 42, 43, 44 and 45. In the plate heat exchanger 31 all the heat transfer plates except for the outermost one 41 and the outermost heat transfer plate closest to the frame plate 32, have all their porthole areas open. The outermost heat transfer plate 41 has two open porthole areas 43 & 44 and two closed porthole areas 42 & 45 just like the outermost heat transfer plate closest to the frame plate 32 (not illustrated). One of the open porthole areas 43 of the heat transfer plate 41 is also visible in FIG. 3*b*. Centre points of the open porthole areas 43 and 44 of the outermost heat transfer plate 41 are aligned with centre points of the open porthole areas 34 and 37, respectively, of the pressure plate 33. Further, centre points of the open porthole areas of the outermost heat transfer plate closest to the frame plate 32 are aligned with a centre point of a respective one of the open porthole areas of the frame plate 32. Aligned (as regards centre points) open porthole areas create ports extending inside the plate heat exchanger. Thus, the plate heat exchanger 31 comprises four ports, each one extending from a respective one of the open porthole areas of the frame and pressure plates 32 and 33, respectively. FIG. 3*b* illustrates one of these ports, denoted 46 and extending from the porthole area 34 of the pressure plate 33.

The heat transfer plates are each divided into different areas which each are provided with a corrugation pattern adapted to the main function of the area. For example, alternately arranged plate ridges and plate valleys in relation to a central extension plane c-c (FIG. 2*b*) (parallel to the figure plane of FIGS. 4*a*-*d*) of the heat transfer plates are provided around the porthole areas. This is illustrated for the heat transfer plate 41 in FIGS. 4*b*-*d* where plate ridges 47 and plate valleys 49 enclose the porthole area 43. The plate ridges and plate valleys have a support function. The plate ridges and valleys of all heat transfer plates but the outermost ones are arranged to abut plate valleys and ridges of adjacent plates. For the outermost heat transfer plates one of the adjacent plates is the frame or pressure plate 32, 33 having essentially plane inner surfaces 48 and 38 respectively. The different areas and corrugation patterns of the heat transfer plates will not be further described herein.

The heat transfer plates each comprise an annular embankment provided around each of the porthole areas. This is illustrated for the porthole area 43 of the heat transfer plate 41 in FIG. 4*c* where the embankment 68 encloses the plate ridges 47 and plate valleys 49. An inner periphery of the embankment 68 is uniform with, but larger than, the porthole area 43 of the heat transfer plate 41. The embankment is formed by an under side of a gasket groove arranged to receive a gasket on the opposite front side of the plate, which will be further discussed below.

In the plate pack 39 the heat transfer plates 40 are separated from each other by gaskets 50 (FIG. 3*b*) arranged in gasket grooves of the heat transfer plates extending along longitudinal outer edges and around the porthole areas of the heat transfer plates. FIG. 4*a* illustrates the outermost heat transfer plate 41 provided with such a gasket 50. The heat transfer plates 40 together with the gaskets 50 form parallel channels arranged to receive two fluids for transferring heat from one fluid to the other. To this end, a first fluid is arranged to flow in every second channel and a second fluid is arranged to flow in the remaining channels. For the channels to be leak-proof, the heat transfer plates 40 must be pressed against each other whereby the gaskets 50 seal between the heat transfer plates. To this end, the plate heat exchanger 31 comprises a number of tightening means 51 arranged to press the frame and pressure plates, 32 and 33, respectively, towards each other.

The first fluid enters and exits the plate heat exchanger 31 through an inlet 52 and an outlet 53, respectively, which are arranged on opposite sides of the plate heat exchanger. Similarly, the second fluid enters and exits the plate heat exchanger 31 through an inlet 54 and an outlet 55, respectively, which are arranged on opposite sides of the plate heat exchanger. Since the inlets 52 and 54 and the outlets 53 and 55 are arranged on opposite sides of the plate heat exchanger 31, both the first and the second fluid will pass through both the frame plate 32 and the pressure plate 33. Centre points of the inlets and outlets are aligned with a centre point of a respective one of the ports. For example, as is clear especially from FIG. 3*b*, the outlet 53 of the first fluid is aligned (as regards centre points) with the port 46.

As mentioned above, all the heat transfer plates 40 of the plate heat exchanger are similar except from as regards the porthole areas which may be open or closed for a heat transfer plate depending on its position in the pack 39 of heat transfer plates. In the pack every other heat transfer plate 40 is rotated 180 degrees in relation to a reference plate orientation. With reference to FIG. 4*a*, every second heat transfer plate is rotated 180 degrees around an axis extending through a centre of the plate, which axis is a normal the central extension plane c-c of the plate, i.e. a normal to the figure plane of FIG. 4*a*.

In the plate heat exchanger 31*a* front side (FIG. 4*a*) of the outermost heat transfer plate closest to the frame plate 32 faces the frame plate while a back side (FIG. 4*b*) of the outermost heat transfer plate 41 closest to the pressure plate 33 faces the pressure plate. A special gasket solution is present between the frame plate 32 and the adjacent outermost heat transfer plate to achieve a suitable seal there between. This gasket solution is not relevant for the present invention and it will therefore not be further discussed. Between the outermost heat transfer plate 41 and the pressure plate 33 a gasket solution according to the invention is present. This gasket solution will be described below.

FIGS. 5*a*-5*e* illustrate an annular rubber porthole gasket 57 for installation between the pressure plate 33 and the outermost heat transfer plate 41 to seal between these, the porthole gasket, outermost heat transfer plate and pressure plate together forming an assembly according to the present invention. When the porthole gasket 57 is installed like this, a central extension plane e-e of the porthole gasket, which extends at half of a maximum height h1 of the porthole gasket, here h1=6 mm, will be parallel to the pressure plate 33 and the outermost heat transfer plate 41. The central extension plane e-e is parallel to the figure plane of FIG. 5*b*.

The porthole gasket has a first surface 60 for engagement with the heat transfer plate 41, more particularly the backside thereof, and a second surface 61 for engagement with the pressure plate 33, more particularly the inner surface 38 thereof. The first surface 60 is undulated and defines alternately arranged gasket ridges 62 and gasket valleys 63 along a longitudinal extension L of the porthole gasket 57. The gasket ridges protrude above, and the gasket valleys descend below, the central extension plane e-e in a normal direction n thereof. The gasket ridges and valleys define an inner periphery 58 of the porthole gasket which encloses an area 59 being uniform with, but larger than, the porthole areas of the heat transfer plates. The second surface 61 is essentially plane and parallel to the central extension plane e-e of the porthole gasket 57.

The first surface 60 further defines a continuous annular first bead or elevation 64. The first bead 64 has an inner periphery which is uniform with the inner periphery 58 of the porthole gasket 57 and it extends concentric therewith along the longitudinal extension L of the porthole gasket. The first bead 64 projects from the gasket ridges 62 and the gasket valleys 63 in the normal direction n of the central extension plane e-e and extends at an essentially constant distant w0 from the inner periphery 58 of the porthole gasket. As is clear from FIG. 5*d*, the first bead protrudes from a respective top 56 of the gasket ridges. Further, the first bead has a constant width w1 and a constant height h2 along its longitudinal extension, the width being measured parallel to the central extension plane and perpendicular to the longitudinal extension of the porthole gasket, i.e. in a "radial" direction of the porthole gasket 57. Here, w0=0.5 mm, w1=1.7 mm and h2=0.2 mm.

The design of the porthole gasket 57 is adapted to the design of the outermost heat transfer plate 41 and the pressure plate 33. For example, to be fit for use with the above described heat transfer plates, the area 59 enclosed by the porthole gasket 57 is "curved triangular", just like the porthole areas of the heat transfer plates. Further, along a portion Z1 (encircled with pointed and dashed line) of the porthole gasket 57 the first surface 60 defines a second bead 66 connecting the gasket ridges within the portion Z1. The second bead is arranged to be accommodated in a groove 70 of the heat transfer plate 41, which groove extends partly around the open porthole area 43. The second bead 66 protrudes in the normal direction n of the central extension plane e-e with a height h5=3.8 mm, extends at a distance w6=2.7 mm from the inner periphery 58 of the porthole gasket 57 and has a width w7=6.3 mm.

Figure 5A:
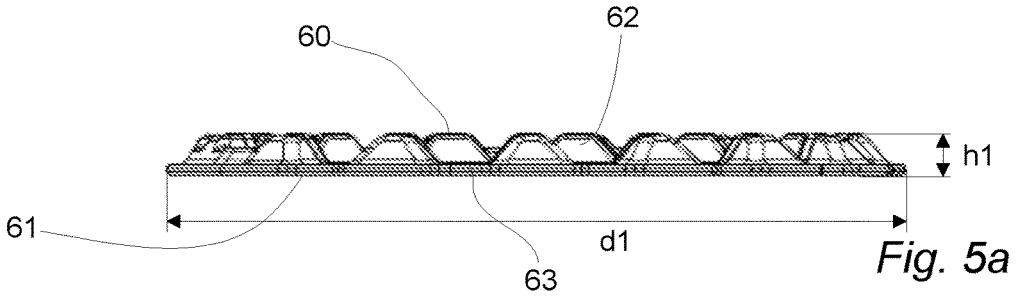
FIG. 5*a* is a side view of a porthole gasket.
Figure 5B:
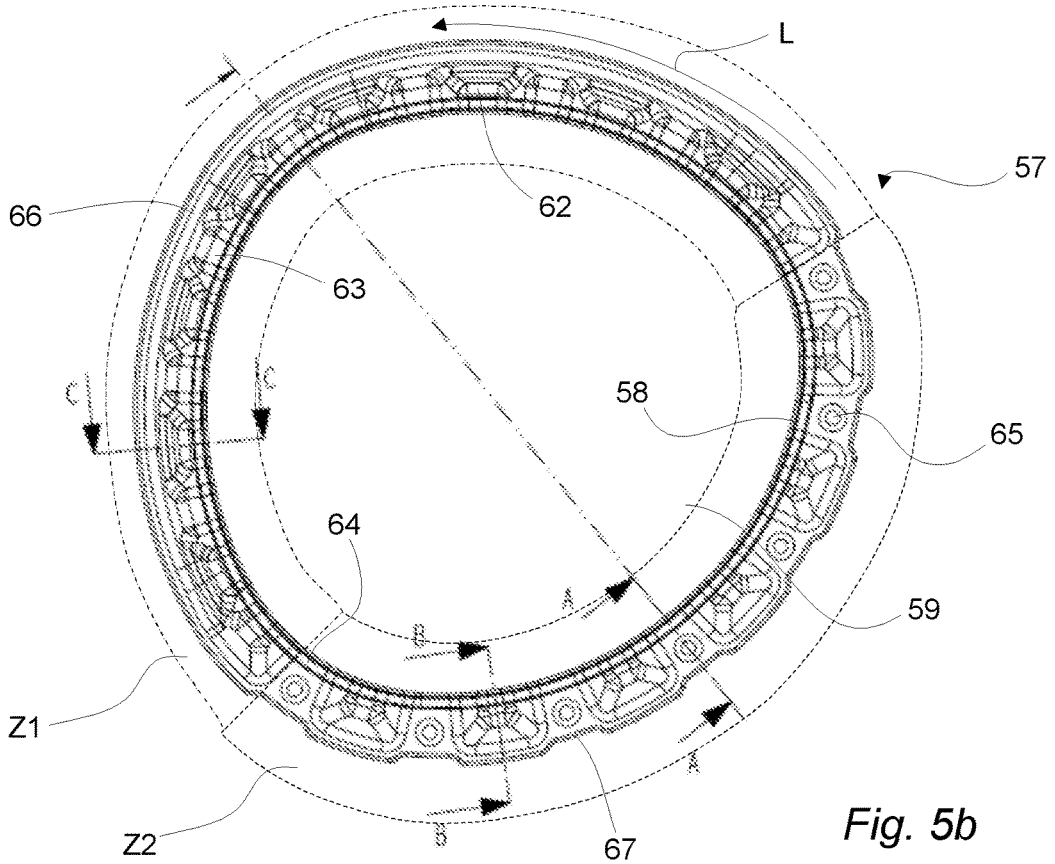
FIG. 5*b* is a plan view of the porthole gasket of FIG. 5*a*.
Figure 5C:
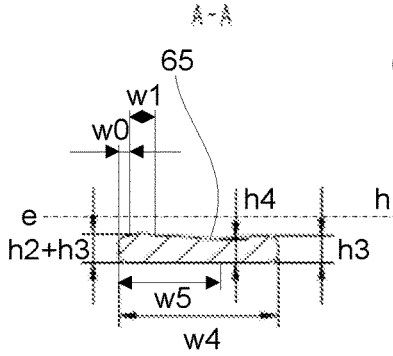
FIG. 5*c* is a cross section through the porthole gasket of FIG. 5*a*, taken along the line A-A in FIG. 5*b*.
Figure 5D:
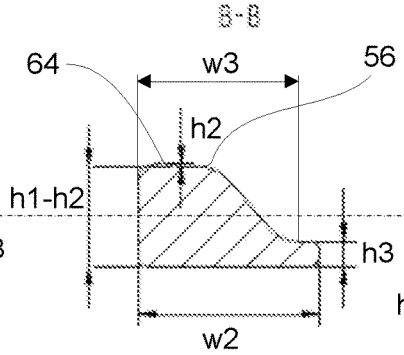
FIG. 5*d* is a cross section through the porthole gasket of FIG. 5*a*, taken along the line B-B in FIG. 5*b*.
Figure 5E:
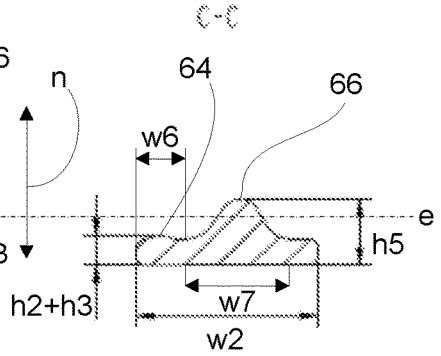
FIG. 5*e* is a cross section through the porthole gasket of FIG. 5*a*, taken along the line C-C in FIG. 5*b*.
Figure 6A:
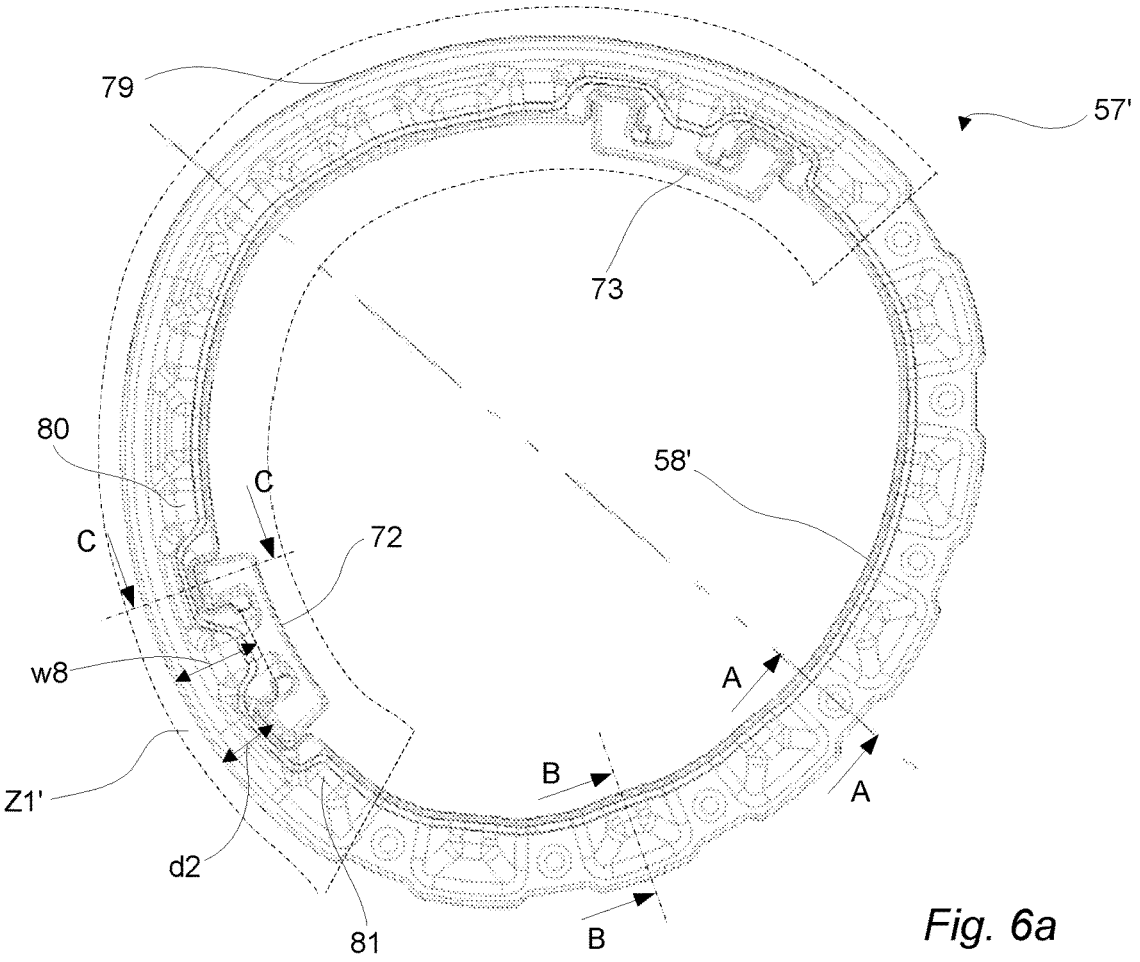
FIG. 6*a* is a plan view of a porthole gasket provided with attachment means.
Figures 6B, 6C, 6D:
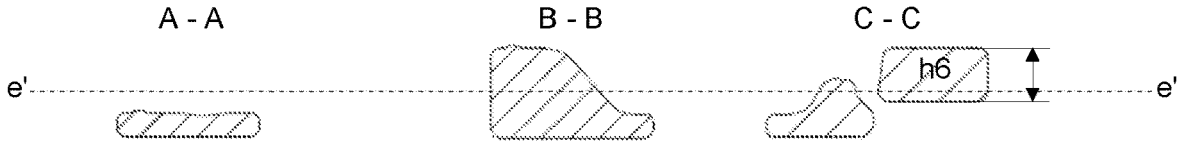
FIG. 6*b* is a cross section taken along the line A-A in FIG. 6*a*.
FIG. 6*c* is a cross section taken along the line B-B in FIG. 6*a*.
FIG. 6*d* is a cross section taken along the line C-C in FIG. 6*a*.
Figure 6E:
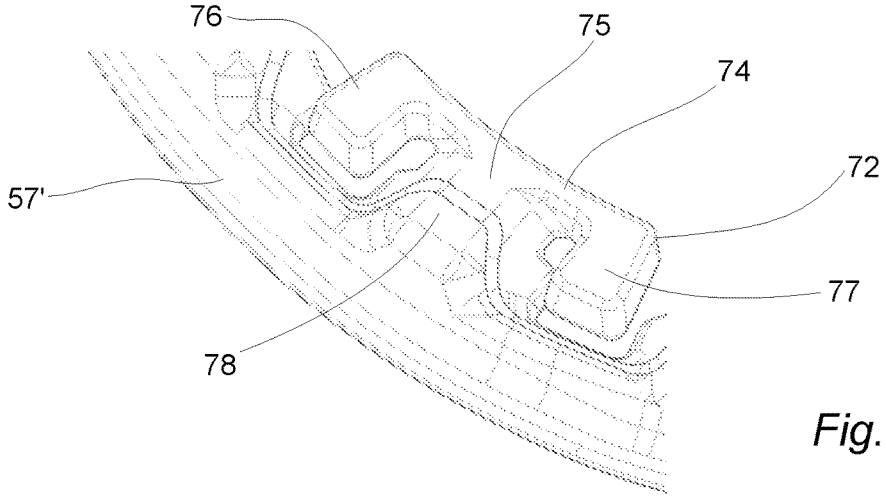
FIG. 6*e* is a perspective view of a portion of the porthole gasket with attachment means of FIG. 6*a*.
Figure 7A:
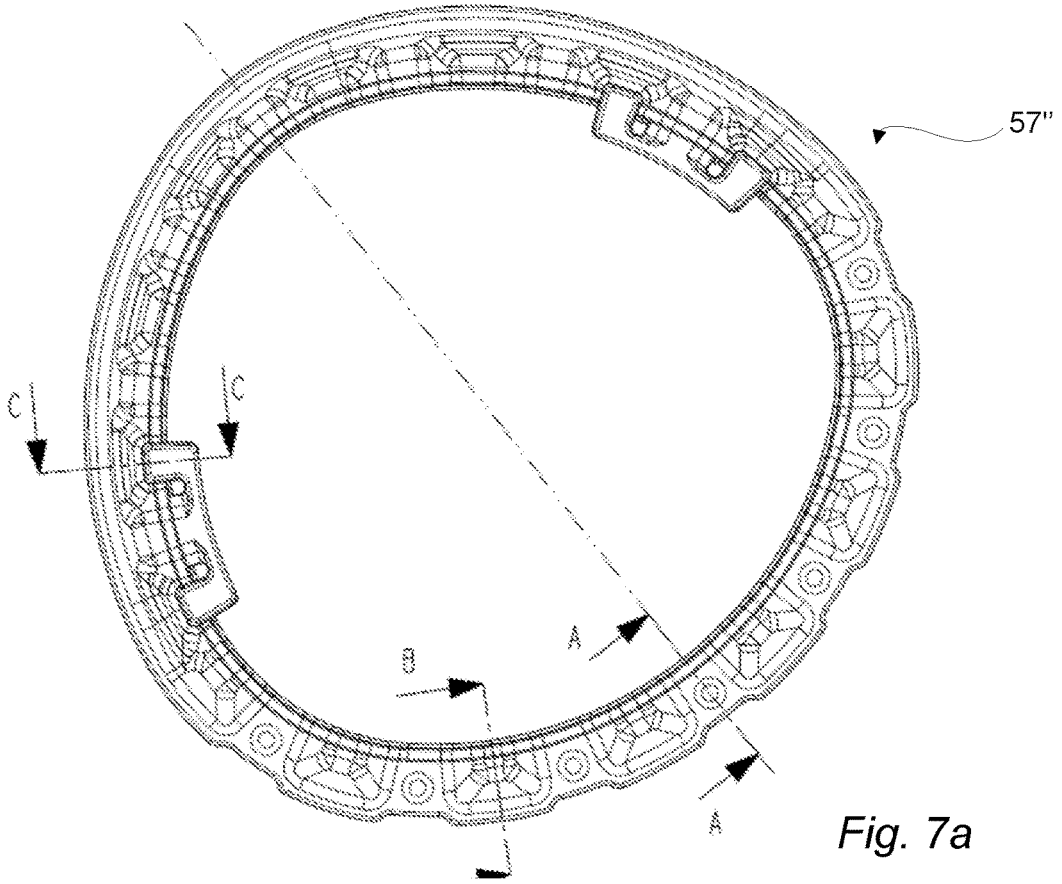
FIG. 7*a* is a plan view of another porthole gasket provided with attachment means.
Figure 7B:
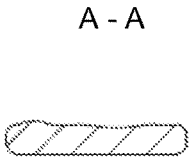
FIG. 7*b* is a cross section taken along the line A-A in FIG. 7*a*.
Figure 7C:
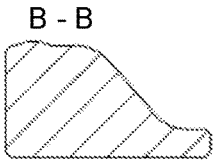
FIG. 7*c* is a cross section taken along the line B-B in FIG. 7*a*.
Figure 7D:
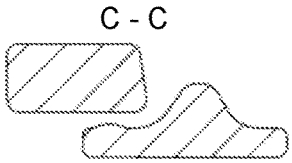
FIG. 7*d* is a cross section taken along the line C-C in FIG. 7*a*.
Figure 7E:
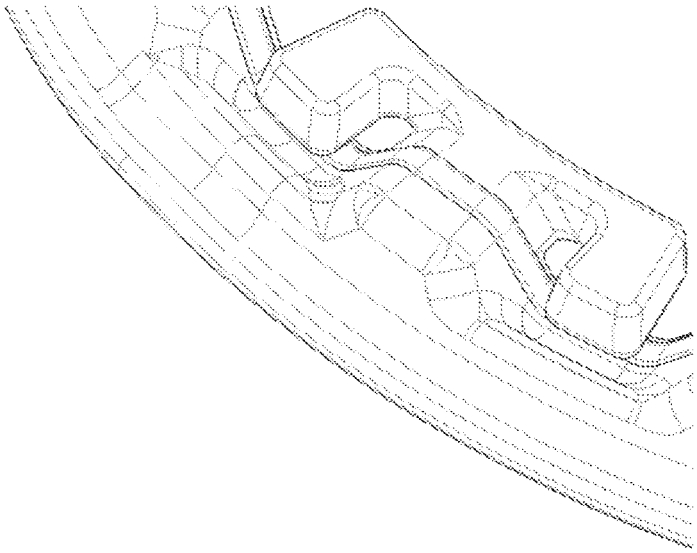
FIG. 7*e* is a perspective view of a portion of the porthole gasket with attachment means of FIG. 7*a*.

As is clear from FIG. 5*b*, the porthole gasket 57 has a varying width along its longitudinal extension L. A width w2 of the porthole gasket along the gasket ridges is larger than the maximum width w3 of the gasket ridges. Further, the width w2 of the porthole gasket along the gasket ridges is larger than a width w4 of the porthole gasket along the gasket valleys along a portion Z2 (encircled with dashed line) of the porthole gasket. As a result, along the portion Z2, the porthole gasket 57 is provided with indentations 67 in a width direction, which indentations provide space for porthole gasket deformation where the porthole gasket is the thinnest (has a minimum height) and thus the most fragile. Thus, the indentations 67 prevent that the porthole gasket is crushed when it is squeezed between the outermost heat transfer plate 41 and the pressure plate 33 in the plate heat exchanger 31. Here, w2=10.45 mm, w3=9.1 mm and w4=9.2 mm.

The portions of the porthole gasket 57 extending beyond the gasket ridges 62 in the width direction extend flush with a bottom of the gasket valleys 63, i.e. at a height h3=1.5 mm. An outer measure d1 of the porthole gasket here equals 106.3 mm.

Along the portion Z2 of the porthole gasket 57 the first surface 60 further defines a recess 65 at each of the gasket valleys, which recess extends in the normal direction n of the central extension plane e-e. A centre of the recess 65 is arranged at a distance w5=5.6 mm from the inner periphery 58 of the porthole gasket 57 and gives the porthole gasket a minimum height h4=1.35 mm. Also the recesses 65 provide space for porthole gasket deformation where the porthole gasket is the most fragile so as to prevent that the porthole gasket is crushed when it is squeezed between the outermost heat transfer plate 41 and the pressure plate 33 in the plate heat exchanger 31.

Thus, because of the second bead 66, the porthole gasket is not particularly prone to crushing within the portion Z1. Since the second bead 66 does not extend along the complete porthole gasket 57, the porthole gasket is provided with the indentations 67 and the recesses 65 within the portion Z2 to prevent porthole gasket crushing.

In the plate heat exchanger 31 the porthole gasket 57 is arranged around and encloses the open porthole area 43 of the outermost heat transfer plate 41 and the open porthole area 34 of the pressure plate 33 (FIG. 3*b*, 4*c*-*d*). Another porthole gasket is arranged around and encloses the open porthole area 44 of the outermost heat transfer plate 41 and the open porthole area 37 of the pressure plate 33. This porthole gasket also has one corrugated surface and one plane surface (i.e. it is designed in accordance with the present invention) but it has a somewhat different design than the porthole gasket 57 to fit the design of the outermost heat transfer plate 41, and especially the structure around the porthole area 44. More particularly, this porthole gasket has a second bead extending along the complete porthole gasket, i.e. connecting all the gasket ridges, since the groove of the outermost heat transfer plate 41 arranged to accommodate the second bead extends completely around the open porthole area 44. In view thereof, this porthole gasket need not be provided with indentations and recesses like the porthole gasket 57.

The following description is focused on the porthole gasket 57. The gasket ridges 62 and the gasket valleys 63 of the porthole gasket 57 mate with the plate valleys 49 and plate ridges 47, respectively, enclosing the porthole area 43, of the outermost heat transfer plate 41, while the second surface 61 engage with the inner surface 38 of the pressure plate 33. Further, the portions of the porthole gasket 57 extending beyond the gasket ridges 62 in the width direction engage with a top surface 69 (FIG. 4*c*) of the embankment 68, which top surface is parallel to the central extension plane e-e of the porthole gasket 57. Arranged like that, the porthole gasket 57 provides a good and reliable sealing between the outermost heat transfer plate 41 and the pressure plate 33 (FIG. 3*b*).

Thus, the porthole gasket according to the invention replaces the three special components required in the known sealing solution for the initially described heat exchanger having the inlet and outlet for one and the same fluid arranged on opposite sides of the heat exchanger. A further advantage of the porthole gasket according to the invention is that there may be a flow between the two plates (two heat transfer plates above) that are most adjacent to the second plate (the pressure plate above). With the known sealing solution, as mentioned above, there may be no flow between the two plates (one heat transfer plate and one transition plate) that are most adjacent to the end plate which results in a worse heat transfer capacity of the heat exchanger.

FIGS. 6*a*-6*e* illustrate another annular rubber porthole gasket 57' according to the present invention. The porthole gasket 57' is very similar to the porthole gasket 57 and generally only the features distinguishing the porthole gasket 57' from the porthole gasket 57 will be described. The porthole gasket 57' is provided with a number of, here two (but could be more or less), attachment means 72 and 73 for fastening the porthole gasket to the outermost heat transfer plate 41 (FIG. 4*a*-4*b*). The attachment means 72 and 73 are similar. The following description will be focused mainly on the attachment means 72, which is illustrated enlarged in FIG. 6*e*.

The attachment means 72 comprises a bridge 74, which is spaced from the porthole gasket 57', a connection member 75 connecting the bridge 74 to the porthole gasket 57', and first and second fingers 76 and 77, respectively, connected to the bridge 74 and extending from the bridge towards the porthole gasket 57' on opposite sides of the connection member 75. The bridge 74, the connection member 75 and the first and second fingers 76 and 77 are of equal height h6 and extend in a common plane parallel to a central extension plane e'-e' of the porthole gasket 57'.

The attachment means 72 is enclosed by the porthole gasket 57' and extends from an inner periphery 58' thereof. The connection member 75 engages with a first gasket ridge 78 of the porthole gasket 57', a top surface of the connection member extending flush with a top surface of the first gasket ridge 78. Lengths of the connection member 75 and the first and second fingers 76 and 77 are such that a shortest distance d2 between an outer periphery 79 of the porthole gasket 57' and each of the first and second fingers is shorter than a width w8 (=w2 of the porthole gasket 57 here) of the porthole gasket 57' along the first gasket ridge 78, i.e. where the connection member 75 connects to the porthole gasket 57'. More particularly, a portion of the first finger 76 extends between the first gasket ridge 78 and an adjacent second gasket ridge 80 of the porthole gasket 57', while a portion of the second finger 77 extends between the first gasket ridge 78 and an adjacent third gasket ridge 81 of the porthole gasket 57'. The first gasket ridge 78 is thus arranged between the second and third gasket ridges 80 and 81, respectively. Further, here, the first, second and third gasket ridges 78, 80 and 81 are arranged within a portion Z1' of the porthole gasket 57' corresponding to the portion Z1 of the porthole gasket 57. Alternatively, one or more of the first, second and third gasket ridges could be arranged outside the portion Z1'.

The porthole gasket 57' is essentially identical to the porthole gasket 57 except for in the areas of the attachment means 72 (and 73). As is clear especially from FIG. 6*d*, the porthole gasket 57' is cut under the first and second fingers 76 and 77, i.e. between the first and second, and the first and third, gasket ridges. More particularly, the porthole gasket 57' comprises cut-outs extending from the inner periphery 58' thereof, two cut-outs for each of the attachment means 72 and 73, so as to make the inner periphery 58' partly wave-shaped and give the porthole gasket 57' a varying width within the portion Z1'.

The attachment means 72 is arranged to engage with an edge portion 82 of the outermost heat transfer plate 41 (FIGS. 4*a*-4*d*), which edge portion defines a porthole 83 of the outermost heat transfer plate in the form of the open porthole area 43, to fasten the porthole gasket 57' to the outermost heat transfer plate. The edge portion is corrugated, comprising ridges 47 and valleys 49, as previously explained. The connection member 75 is arranged to engage with the backside (FIGS. 4*b*-4*d*) of the outermost heat transfer plate 41 while the first and second fingers are arranged to engage with the front side (FIG. 4*a*) of the outermost heat transfer plate. Thus, the plate edge portion 82 is arranged to be "pinched" between the connection member and the first and second fingers of the attachment means so as to fasten the porthole gasket to the outermost heat transfer plate.

FIGS. 7*a*-7*e* illustrate yet another annular rubber porthole gasket 57" according to the present invention. The porthole gasket 57" and is essentially identical to the porthole gasket 57' except for that the porthole gasket 57" lacks the cut-outs under the first and second fingers of the attachment means. The cut-outs may make the porthole gasket 57' somewhat easier to manufacture than the porthole gasket 57".

The above described embodiments of the present invention should only be seen as examples. A person skilled in the art realizes that the embodiments discussed can be varied and combined in a number of ways without deviating from the inventive conception.

As an example, the above given set of measures of the porthole gasket is just one example of a countless number of possible different, working sets of measures. Naturally, the measures of the porthole gasket should be adapted to the application of the plate heat exchanger and the design of the heat transfer, frame and pressures plates, but different designs of the porthole gasket may work well for one and the same application and set of plates.

For instance, the width, height and position of the first and second beads of the porthole gasket could be varied, within certain limits, with unaltered performance of the porthole gasket. As a non-limiting example, for a porthole gasket adapted to the above described plates, the height h2 of the first bead could be 2-10% of the maximum height h1 of the porthole gasket. Further, as another non-limiting example, the width w1 of the first bead could be 5-25% of the maximum width w2 of the porthole gasket. Furthermore, the first and second beads of the porthole gasket as uncompressed could be discontinuous, whereby the discontinuities could be eliminated during compression of the porthole gasket in the plate heat exchanger.

As a further example, the position, shape and/or number of recesses could be varied. More particularly, the recesses could be arranged closer to/more distant from the inner periphery of the porthole gasket, and they could be provided only at a few of the gasket valleys along the portion Z2 of the porthole gasket. Further, the shape and/or number of the indentations 67 could be varied.

The plate heat exchanger described above comprises two porthole gaskets (with different designs but both according to the invention), one for each pair of open porthole areas of the outermost heat transfer plate and the pressure plate. Porthole gaskets are not required between the outermost heat transfer plate and the pressure plate where the porthole areas are closed, not even for support, which is an additional advantage of the porthole gasket according to the invention. This is because the outermost heat transfer plate and the pressure plate are so closely arranged in the plate heat exchanger that there is no risk of deformation of the outermost heat transfer plate. However, if required, e.g. for support, porthole gaskets could be arranged also around the closed porthole areas of the outermost heat transfer plate and the pressure plate.

The inner periphery of the porthole gasket and the porthole areas of the heat transfer plates may have any shape, such as circular, oval, etc. Further, they need not be uniform and/or concentric. The same reasoning is valid for the porthole areas of the frame and pressure plates, which e.g. may be curved triangular.

The porthole gasket may be made of another material than rubber. Similarly, the frame and pressure plates could be made of another material than stainless steel, such as carbon steel. Also the heat transfer plates could be made of another material than stainless steel, such as titanium.

Above, the plate arrangement (term used in the claims) consists of the second plate, i.e. the pressure plate. To protect the frame and pressure plates from fluid exposure possibly causing corrosion, especially if the frame and pressure plates are made of a less corrosion resistant material such as carbon steel, the open porthole areas of the frame and pressure plates could be provided with linings, e.g. in stainless steel. In such a case, the plate arrangement would comprise the second plate and at least one lining and the porthole gasket could be arranged to engage with the lining instead of directly with the second plate.

The porthole gaskets described with reference to FIGS. 6*a*-6*e* and 7*a*-7*e* comprise attachment means in the form of so called clip on tabs. Naturally, the porthole gasket could be provided with additional/other types of attachment means, internal and/or external, arranged for engagement with (an) inner and/or outer edge(s) of the outermost heat transfer plate.

The heat transfer plates of the plate heat exchanger need not all be similar but could be of two or more different, alternately arranged, types.

The first and second plates need not be an outermost heat transfer plate and a pressure plate, respectively, but could for example be a heat transfer plate and a partition plate or an outermost heat transfer plate and a frame plate. A partition plate is a flow division plate that may be arranged in the pack of heat transfer plates, between two heat transfer plates. It is typically a sheet metal plate, not corrugated, and it may comprise both closed and open porthole areas.

The complete inner surface of the pressure plate need not be essentially plane as long as the part of the inner surface arranged to engage with the second surface of the porthole gasket is essentially plane.

It should be stressed that a description of details not relevant to the present invention has been omitted and that at least some of the figures are just schematic and not drawn according to scale. It should also be said that some of the figures have been more simplified than others. Therefore, some components may be illustrated in one figure but left out or simplified in another figure.

The invention claimed is:

1. A porthole gasket for installation between a corrugated first plate, in a form of a heat transfer plate, and a second plate, in a form of an end plate, of a heat exchanger such that a central extension plane of the porthole gasket is parallel to the first and second plates, the corrugated first plate in the form of the heat transfer plate comprising plate ridges extending in an upper plane, plate valleys extending in a lower plane and a gasket groove configured to accommodate a plate gasket on a front side of the corrugated first plate, the porthole gasket being annular and arranged to enclose, within an inner periphery of the porthole gasket, a porthole area of the corrugated first plate and a porthole area of the second plate, wherein a first surface of the porthole gasket, which is arranged to engage with a back side of the corrugated first plate, is corrugated so as to define alternately arranged gasket ridges and gasket valleys along a longitudinal extension of the porthole gasket, the gasket ridges each possessing a top and the gasket valleys each possessing a bottom, the gasket ridges and the gasket valleys being arranged to mate with the plate valleys and the plate ridges, respectively, of the corrugated first plate, and a second surface of the porthole gasket, which is arranged to engage with a plate arrangement comprising the second plate, is essentially plane and not corrugated and is arranged to contact an essentially plane surface of the plate arrangement, the gasket ridges protruding, and the gasket valleys descending, in a normal direction of the central extension plane so that the tops of the gasket ridges are positioned elevationally above the bottoms of the gasket valleys when the second surface of the porthole gasket is facing downward in a direction perpendicular to the central extension plane, the porthole gasket possessing a width measured parallel to the central extension plane and perpendicular to the longitudinal extension of the porthole gasket.

2. The porthole gasket according to claim 1, wherein the gasket ridges and the gasket valleys define the inner periphery of the porthole gasket.

3. The porthole gasket according to claim 1, wherein the first surface of the porthole gasket defines a first bead extending along the longitudinal extension of the porthole gasket and protruding from the gasket ridges and the gasket valleys in the normal direction of the central extension plane.

4. The porthole gasket according to claim 3, wherein the first bead is located at and protrudes away from the respective top of the gasket ridges so that the first bead is elevationally above the respective top of the gasket ridges.

5. The porthole gasket according to claim 1, wherein the gasket ridges possess a maximum width, and a width of the porthole gasket along the gasket ridges is larger than the maximum width of the gasket ridges.

6. The porthole gasket according to claim 1, wherein the porthole gasket includes a first portion extending in the longitudinal extension of the porthole gasket, and a width of the porthole gasket along the gasket ridges is larger than a width of the porthole gasket along the gasket valleys in the first portion of the porthole gasket.

7. The porthole gasket according to claim 1, wherein the first surface at a plurality of the gasket valleys includes a recess that is elevationally below the bottoms of the gasket valleys, the recess extending in the normal direction of the central extension plane.

8. The porthole gasket according to claim 1, wherein the first surface defines a second bead extending along the longitudinal extension of the porthole gasket and connecting a plurality of the gasket ridges, the second bead protruding in the normal direction of the central extension plane, the second bead extending at a position spaced from the inner periphery of the porthole gasket.

9. The porthole gasket according to claim 1, further comprising attachment means arranged to engage an edge portion of the first plate that defines a porthole of the first plate, for fastening the porthole gasket to the first plate, the attachment means engaging with and extending from the inner periphery of the porthole gasket.

10. The porthole gasket according to claim 9, wherein the attachment means comprises a bridge which is spaced from the porthole gasket, a connection member connecting the bridge and the porthole gasket, and first and second fingers engaging with the bridge and extending from the bridge towards the porthole gasket, the connection member being arranged to engage with the back side of the first plate and the first and second fingers being arranged to engage with a front side of the first plate.

11. The porthole gasket according to claim 10, wherein a shortest distance between an outer periphery of the porthole gasket and each of the first and second fingers is shorter than a width of the porthole gasket where the connection member connects to the porthole gasket.

12. The porthole gasket according to claim 10, wherein the connection member connects to the porthole gasket at a first one of the gasket ridges, the first finger extends at least partly between the first one of the gasket ridges and an adjacent second one of the gasket ridges, and the second finger extends at least partly between the first one of the gasket ridges and an adjacent third one of the gasket ridges, the first one of the gasket ridges being arranged between the second one of the gasket ridges and the third one of the gasket ridges.

13. An assembly for a heat exchanger comprising the porthole gasket according to claim 1 installed between the corrugated first plate in the form of the heat transfer plate and the second plate in the form of the end plate such that the central extension plane of the porthole gasket is parallel to the first and second plates, wherein the porthole gasket encloses the porthole area of the first and second plates, the first surface of the porthole gasket engaging the plate ridges and the plate valleys of the first plate that are alternately arranged around the porthole area of the first plate, and the second surface of the porthole gasket engaging the essentially plane surface of the plate arrangement comprising the second plate that extends around the porthole area of the second plate.

14. The assembly according to claim 13, wherein the first plate is an outermost heat transfer plate of a pack of mutually aligned heat transfer plates and the second plate is an end plate arranged to compress the pack of heat transfer plates.

15. The assembly according to claim 13, wherein the porthole areas of the first and second plates are open.

16. A porthole gasket configured to be installed between a corrugated first plate, in a form of a heat transfer plate, and a second plate, in a form of an end plate, of a heat exchanger such that a central extension plane of the porthole gasket is parallel to the first and second plates, the corrugated first plate in the form of the heat transfer plate comprising plate ridges extending in an upper plane, plate valleys extending in a lower plane and a gasket groove configured to accommodate a plate gasket on a front side of the corrugated first plate, the porthole gasket possessing a longitudinal extension defining an annular shape to enclose, within an inner periphery of the porthole gasket, a porthole area of the corrugated first plate and a porthole area of the second plate, the porthole gasket possessing a first surface and a second surface that face in opposite directions, the first surface of the porthole gasket being arranged to engage a back side of the corrugated first plate and being corrugated to define gasket ridges and gasket valleys that alternate with one another along the longitudinal extension of the porthole gasket before the porthole gasket is installed between the first and second plates, the gasket ridges each possessing a top and the gasket valleys each possessing a bottom, the gasket ridges and the gasket valleys being arranged to mate with the plate valleys and the plate ridges, respectively, of the corrugated first plate, the second surface of the porthole gasket being not corrugated and essentially plane and arranged to contact an essentially plane surface of a plate arrangement comprising the second plate, the gasket ridges protruding in a direction perpendicular to the central extension plane so that the tops of the gasket ridges are located on one side of the central extension plane, the gasket valleys descending in the direction perpendicular to the central extension plane so that the bottoms of the gasket valleys are located on an opposite side of the central extension plane, the porthole gasket possessing a width measured parallel to the central extension plane and perpendicular to the longitudinal extension of the porthole gasket.

17. The porthole gasket according to claim 16, wherein the gasket ridges and the gasket valleys each possess an inner periphery forming a part of the inner periphery of the porthole gasket.

* * * * *